US006127994A

United States Patent [19]

Ellis, II et al.

[11] Patent Number: 6,127,994

[45] Date of Patent: Oct. 3, 2000

[54] METHOD FOR MULTIPLEX DRIVING A PASSIVE LIQUID CRYSTAL DISPLAY (LCD) USING MODULATED PULSE WIDTHS

[75] Inventors: David L. Ellis, II, Coconut Creek; Ruben Rivera, Sunrise; Patrick M. Dunn, Coral Springs, all of Fla.

[73] Assignee: Motorola, Inc., Schaumburg, Ill.

[21] Appl. No.: 08/847,646

[22] Filed: Apr. 30, 1997

[51] Int. Cl.[7] ..... G09G 3/36

[52] U.S. Cl. ..... 345/94; 345/208

[58] Field of Search ..... 345/94, 99, 87, 345/204, 208

[56] References Cited

U.S. PATENT DOCUMENTS 4,901,066 2/1990 Kobayashi et al. ..... 345/94
5,774,103 6/1998 Choi et al. ..... 345/94
5,818,411 10/1998 Sakamoto et al. ..... 345/99

*Primary Examiner*—Matthew Luu
*Attorney, Agent, or Firm*—Frank M. Scutch, III

[57] ABSTRACT

The method of the present invention produces a plurality of bi-level waveforms on the ROW/common lines and COLUMN/segment lines of a passive multiplexed liquid crystal display (LCD). These waveforms drive the LCD display using binary data from display memory locations. At periodic intervals a counter is incremented while the counter value is then used to 1) look-up in a table the bi-level data to output on the ROW/commons; 2) look-up memory locations associated with the active COLUMN/segments; and 3) to provide inverted COLUMN/segments data before sending the bi-level data to the COLUMN/segment lines of the LCD. The counter increments from zero to four times the number of ROW/commons before being reset to zero and the waveforms repeated. Thus, an algorithm produces one ON/select voltage and one OFF/non-select voltage that are provided to the LCD.

11 Claims, 2 Drawing Sheets

METHOD FOR MULTIPLEX DRIVING A PASSIVE LIQUID CRYSTAL DISPLAY (LCD) USING MODULATED PULSE WIDTHS

TECHNICAL FIELD

This invention relates in general to electronic display of information and more particularly to liquid crystal displays (LCD).

BACKGROUND

Many electronic consumer products today utilize some type of electronic display. This display may offer almost any type of numerical or graphical information to the user relating to status and/or mode of operation of the electronic device. Depending on the type of display that is to be used, there are many types of technologies available for driving the display in order to display the required information. As seen in prior art system 100 of FIG. 1, a microprocessor 101 is used with a display driver 103 and resister network 105 to drive i.e. supply information to the LCD display 107.

One such LCD display is a twisted nematic (TN) display. The TN display is commonly used because it is capable of displaying a moderate amount of information to the user while still maintaining low cost with minimal implementation effort. In order to optimize display functionality, a number of low cost liquid crystal display solutions have been developed for use with the TN display using Pulse Width Modulation (PWM). These techniques utilize a driving scheme that enables a multiple character TN display to be incorporated into an electronic device using a limited number of control lines from an associated microprocessor. This type of scheme eliminates the need for all external components and thus can greatly reduce the manufacturing cost of the display.

For example, a standard liquid crystal display multiplex (LCD MUX) drive operates by addressing/selecting a single row of the LCD at a time. After this selection, the desired ON/OFF states are applied to that selected row through the LCD columns which are common to all ROWs. Rows are selected in a continuing round-robin fashion. Only when a row is addressed/selected, do the states on the columns affect a row, otherwise on unselected rows, the column states are seen as low level noise. Therefore, Table 1 shows each row supplied with the following type of waveform:

TABLE 1

| Row selected | Column 1 | Column x |
|---|---|---|
| unselected | low level noise | low level noise |
| selected | significant on/off info | significant on/off info |
| unselected | low level noise | low level noise |
| unselected | low level noise | low level noise |

As is evident to those skilled in the art, time division is being used to select one row at a time. The method of selecting the row is by supplying the row selected with voltage amplitude several times the level of unselected rows. The method of selecting the row is therefore voltage division multiplexing.

Voltage division multiplexing is a technique requiring more than two driven voltage levels. This technique is not possible with digital circuitry since digital circuitry by definition is limited to two voltage levels. Thus, in modern day electronic equipment that includes an multiplexed LCD display, some type of analog circuitry is required to interface the multiplexed LCD to the equipment's control circuits. In general, digital circuits are smaller and less costly than analog circuits for similar functions, and therefore an all digital multiplexed LCD drive scheme would be of smaller size and less costly to implement than an analog multiplexed LCD drive scheme.

Accordingly, the need exists for a digital drive scheme for an LCD multiplexed display that can be used with electronic devices and circuits having easy implementation and low cost.

DETAILED DESCRIPTION OF THE PREFERRED EMBODIMENT

Figure 1:
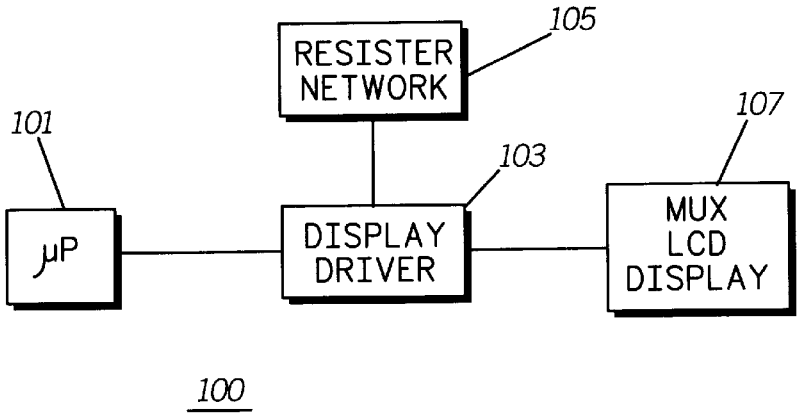
FIG.1 (PRIOR ART)
FIG. 1 is a prior art block diagram showing the standard drive scheme for liquid crystal displays.
Figure 2:
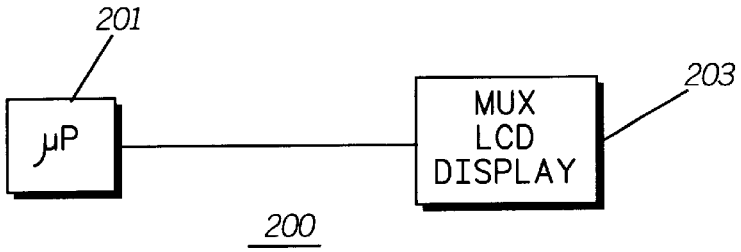
FIG. 2 is block diagram showing operation the multiplexed liquid crystal display according to the preferred method of the invention.

Referring now to FIG. 2, a block diagram 200 shows the architecture of the preferred embodiment of the invention. A microprocessor 201 is used to drive a multiplexed liquid crystal display (LCD) 203. As is evident from the operation of the invention, the display driver and resistor biasing network as used in the prior art have been eliminated.

For an LCD display to be designed into a product in typical fashion requires that an LCD driver integrated circuit be provided to control the LCD. Several costs are associated with the use of an LCD driver which include the cost of the LCD driver integrated circuit (IC), the cost of a resistor divider network to provide multiple drive voltage levels, a power supply booster to generate drive voltages needed for medium multiplex rates, and power supply control to implement temperature compensation for the LCD. The LCD driver IC along with its support circuitry also add cost in that the printed circuit board (PCB) area of the product increases to accommodate the extra circuitry. This increase in area may also increase the overall size and weight of the product. Substantial cost savings are achieved using the invention described herein because the need for the LCD driver IC, driver boosted power supply, power supply resistor divider network, and power supply adjustment circuits for temperature compensation are eliminated.

In the preferred embodiment, the product microcomputer or microprocessor 201 is used to drive the LCD 203 in the electronic device. If, however, insufficient microcomputer output port pins are available, it would still be desirable (and a cost reduction compared to typical LCD driver schemes) to implement a pulse width modulation liquid crystal display multiplex (PWM LCD MUX) drive in a separate LCD driver IC. As compared with typical LCD driver IC parts, the PWM driver does not require a boosted power supply voltage, resistor dividers, nor does the power supply require adjustment for temperature compensation. Additionally, the PWM LCD drive provides comparable display contrast quality when refreshing the display at half the speed of standard drive techniques. This reduction in speed translates into lower power dissipation and improved product battery life.

On problem of PWM LCD MUX drive method as compared to standard LCD MUX drive schemes is that as the PWM multiplex rate increases the select and non-select voltages as seen by the liquid crystal material are moved closer together. This has the effect of placing more stringent performance criteria on the liquid crystal requiring the transition between ON and OFF states to become increasingly steep for higher multiplex rates. This phenomenon of the select/non-select voltages moving closer together will limit the use of PWM to substantially low or medium multiplex rates that are less than approximately 30 multiplex ROWS with current state of the art liquid crystal materials.

Figure 3:
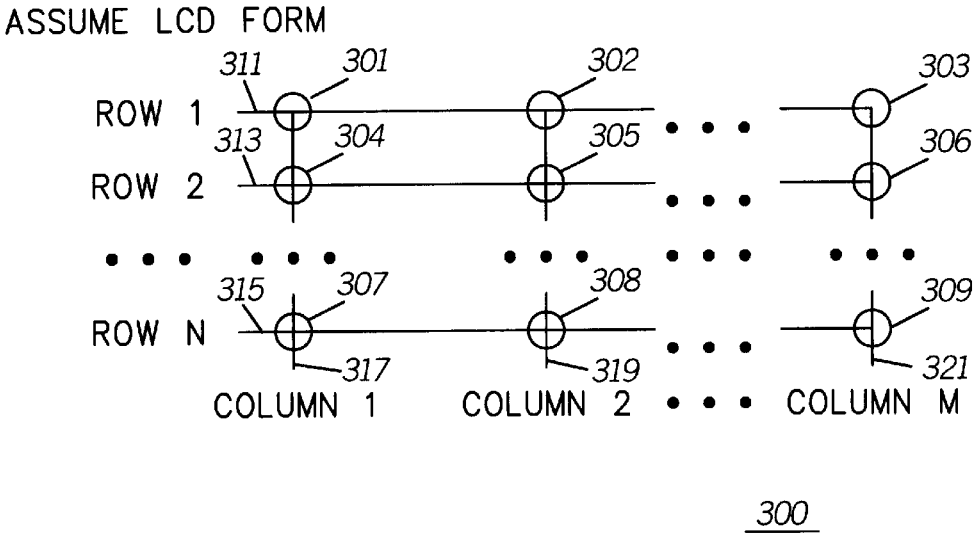
FIG. 3 is a diagram illustrating the row and column structure of a typical LCD display.
Figure 4:
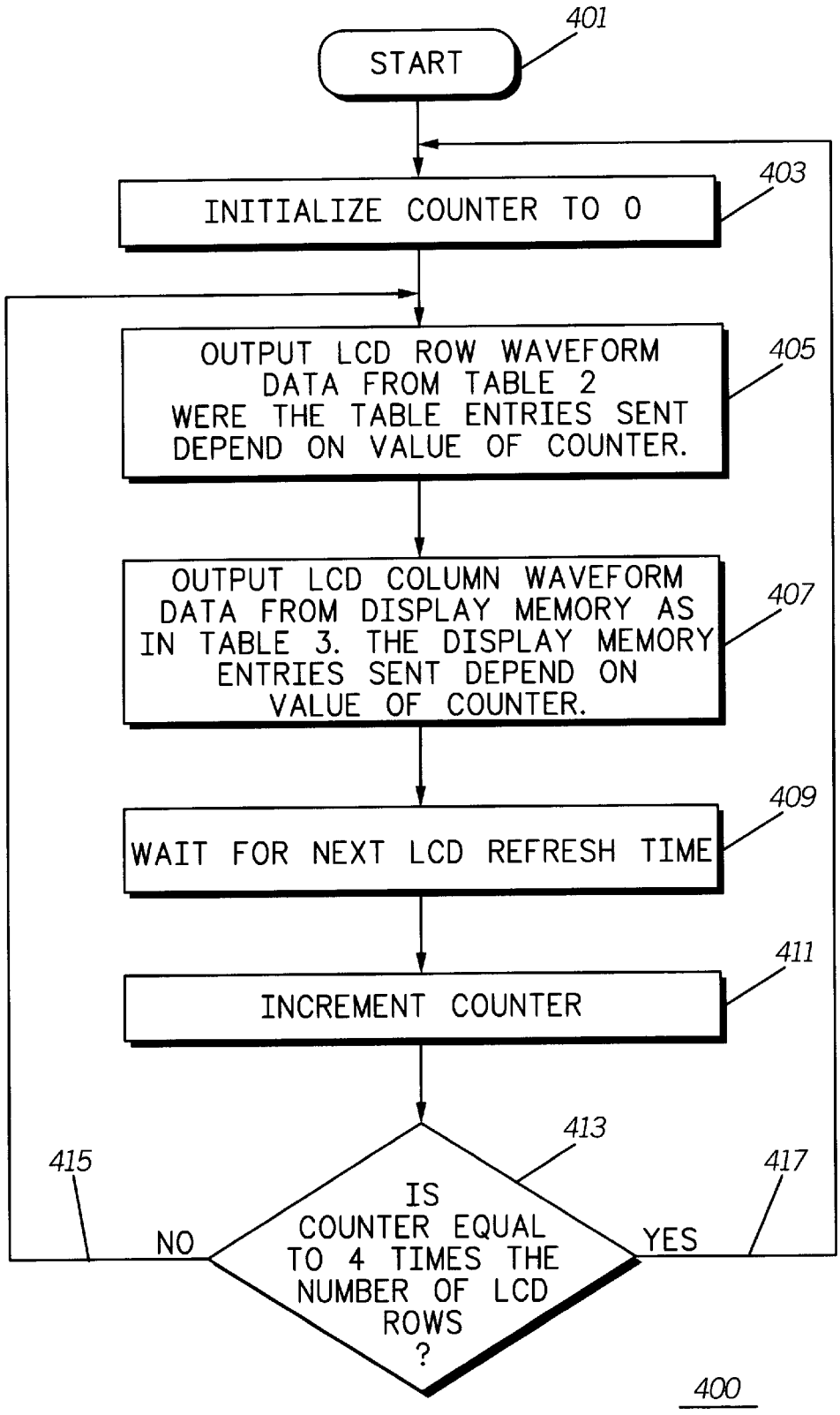
FIG. 4 is a flow chart illustrating the preferred method of utilizing a multiplex drive waveform for a liquid crystal display according to the preferred embodiment of the invention.

In FIG. 3, a wiring diagram 300 of a multiplexed LCD illustrates the configuration of a typical LCD used in the preferred embodiment of the invention. Each point or circle 301 to 309 represents an LCD segment. An LCD segment is conceptually formed as a layered structure with the ROW conductor 311, 313, or 315 on top, a COLUMN conductor 317, 319, or 321 on bottom, and liquid crystal material (not shown) in between these conductors. Assuming the display memory has one bit per display segment, e.g. intersection of ROW y and COLUMN x designated Sxy where y=1 to N for ROWs and x=1 to M for COLUMNs. If the bit Sxy=1, then the corresponding LCD segment will be in an ON state, else if the bit Sxy=0, then the corresponding LCD segment will be in the OFF state In FIG. 4 a flow chart 400 illustrates the preferred method of generating a multiplex drive waveform for a liquid crystal display. A COUNTER variable is maintained to track the number of iterations through the algorithm and to identify which ROW the present iteration is manipulating. The START 401 step is entered when the equipment with LCD is activated. In step 403, the COUNTER is initialized to zero and the inner algorithm loop is then entered. In step 405 the ROW lines 311, 313, 315 with values determined from Table 2 below. In step 407, the COLUMN lines 317, 319, 321 are driven with values determined from Table 3below.

For example, those skilled in the art will recognize that because the ROW and COLUMN are being driven with bi-level waveforms, that are of equivalent amplitude, a voltage potential will either be applied to a particular segment or a zero voltage potential will be applied to that particular segment during each and every display update time period. The sum of the display update time periods form a display refresh waveform. This PWM technique is simplistic since a non-zero voltage potential is applied to an LCD segment for greater than 50% of the refresh waveform duty cycle to turn the segment ON and for less than 50% of the refresh waveform duty cycle to turn the segment OFF. To preserve the integrity of the liquid crystal material, the algorithm produces the same number of non-zero positive voltage potential time periods and non-zero negative voltage potential time periods or pulses during a complete display refresh waveform cycle or period.

The multiplexing is accomplished by manipulating the waveform on the COLUMN lines such that in relation to a fixed repeating pattern on the ROW lines each individual segment is controlled to the proper ON or OFF state. The ROW lines are stimulated with a fixed repeating or periodic pattern that applies binary waveforms whose relationship is mathematically orthogonal to one other. This is accomplished by supplying or 'marching a logic 0' through the first quarter of the ROW wave and 'marching a logic 1' through the third quarter of the ROW wave. The second quarter and fourth quarter of the ROW wave are needed to assure that only one select and one non-select voltage is produced.

The manipulation of COLUMN data follows a simple rule with respect to the repeating ROW waves of the preceding paragraph. In the first quarter of the LCD refresh cycle, the position of the marching logic 0 logically marks that ROW as active. The ON/OFF LCD segment data for the active ROW is placed on the COLUMN lines during the cycle first quarter. During the time periods of the second quarter, the COLUMN data waveform that was output during the cycle first quarter is repeated. In the third quarter of the LCD refresh cycle, the position of the marching logical 1 marks that ROW as active. The inverse of the ON/OFF LCD segment data for the active ROW is placed on the COLUMN lines during the cycle third quarter. During the time periods of the fourth quarter, the COLUMN data waveform that was output during the cycle third quarter is repeated. Thus, the bi-level waveforms for the COLUMNS are formed to produce the desired ON or OFF state by either copying a binary equivalent directly to a COLUMN output port of the LCD or copying and inverting the ON or OFF state to a COLUMN output port.

A check of all possible ON/OFF segment combinations when applying the PWM algorithm will show that only one select and one non-select voltage is produced at each LCD segment and that the voltage produced is select when the segment data is set to be ON and non-select when the segment data is to be OFF. LCD MUX rates for 3, 4, and 5 multiplex ROWs were exhaustively checked and verified. Mathematically, the PWM LCD MUX drive scheme can be extended to any desired MUX rate. In practice, a display with twenty-nine multiplexed ROWs has been constructed and operates well using the PWM MUX LCD drive technique.

As will be evident to those skilled in the art, the voltage difference seen by each LCD segment 301 to 309 formed by the segment's corresponding ROW and COLUMN values determines the segment waveform shape. For the duration of step 409, each waveform remains unchanged. In a practical system where this method would be implemented, all other computational and control tasks will be executed during the waiting period of step 409. Moreover, in step 411 the COUNTER is incremented and checked for the inner loop terminal count equal to four times the number of ROWs in the LCD display. If the COUNTER is a lesser value, step 415 is taken and the algorithm continues. If the COUNTER is a greater value then all ROWs of the display have been processed so step 417 is taken which reinitializes or resets the COUNTER to zero and the algorithm begins anew.

The standard LCD MUX method applies all of the select voltage in a single time period of the display refresh cycle. In contrast, the PWM LCD MUX drive method of the invention does not operate in this fashion. Instead PWM LCD MUX spreads the select voltage over the entire display refresh cycle. The algorithmic/software view of the drive scheme is substantially similar to the standard MUX drive, 1) select a ROW, 2) output on the COLUMNs the ON/OFF states of the selected ROW, 3) deselect the current ROW, 4) go to next ROW and repeat steps. However in the present invention, there is no difference between the ROW select and non-select voltage amplitude. In operation, each ROW is addressed while a portion of a root mean squared (RMS) voltage may be added to each LCD segment. The sum total of all the RMS voltage portions cause the PWM LCD segment to be either in an ON or OFF state. In Table 2, waveform data for each ROW of the liquid crystal display is used for the flow chart diagram illustrated in FIG. 4.

TABLE 2

| ROW data versus COUNTER value | | | | | | | | | | | | | | |
|---|---|---|---|---|---|---|---|---|---|---|---|---|---|---|
| COUNTER | 0 1 2 . . . | (N − 1) | N | . . . | (2N − 1) | 2N | (2N + 1) | (2N + 2) | . . . | (3N − 1) | 3N | . . . | (4N − 1) |
| ROW 1 | 0 1 1 . . . | 1 | 0 | 0 | . . . | 1 | 0 | 0 | . . . | 0 | 1 | . . . | 1 |
| ROW 2 | 1 0 1 . . . | 1 | 0 | 0 | . . . | 0 | 1 | 0 | . . . | 0 | 1 | . . . | 1 |
| ROW 3 | 1 1 0 . . . | 1 | 0 | 0 | . . . | 0 | 0 | 1 | . . . | 0 | 1 | . . . | 1 |
| . . . | | | | | | | | | | | | | |
| ROW N | 1 1 1 . . . | 0 | 0 | 0 | . . . | 0 | 0 | 0 | . . . | 1 | 1 | . . . | 1 |

TABLE 3

| COLUMN data versus COUNTER value, "*" indicates to invert the bit value. | | | | |
|---|---|---|---|---|
| COUNTER | COLUMN 1 | COLUMN 2 | COLUMN 3 | COLUMN M |
| 0 | S11 | S21 | S31 | . . . SM1 |
| 1 | S12 | S22 | S82 | . . . SM2 |
| 2 | S13 | S23 | s33 | . . . SM3 |
| . . . | . . . | . . . | . . . | . . . . . |
| (N − 1) | S1(N − 1) | S2(N − 1) | S3(N − 1) | . . . SM(N − 1) |
| N | S11 | S21 | S31 | . . . SM1 |
| (N + 1) | S12 | S22 | S32 | . . . SM2 |
| (N + 2) | S13 | S23 | S33 | . . . SM3 |
| . . . | . . . | . . . | . . . | . . . . . |
| (2N − 1) | S1(N − 1) | S2(N − 1) | S3(N − 1) | . . . SM(N − 1) |
| 2N | S11* | S21* | S31* | . . . SM1* |
| (2N + 1) | S12* | S22* | S32* | . . . SM2* |
| (2N + 2) | S13* | S23* | S33* | . . . SM3* |
| . . . | . . . | . . . | . . . | . . . . . |
| (3N − 1) | S1(N − 1)* | S2(N − 1)* | S3(N − 1)* | . . . SM(N − 1)* |
| 3N | S11* | S21* | S31* | . . . SM1* |
| (3N + 1) | S12* | S22* | S32* | . . . SM2* |
| (3N + 2) | S13* | S23* | S33* | . . . SM3* |
| . . . | . . . | . . . | . . . | . . . . . |
| (4N − 1) | S1(N − 1)* | S2(N − 1)* | S3(N − 1)* | . . . SM(N − 1)* |

To summarize, the method of the present invention produces bi-level waveforms on the ROW/common lines and COLUMN/segment lines of a multiplexed LCD that drive the display using the binary data from display memory locations. At periodic intervals a counter is incremented. The counter value is then used to 1) look-up in a table the bi-level data to output on the ROW/commons, and 2) look-up memory locations associated with the active COLUMN/segments, 3) to invert or not invert the COLUMN/segments data before sending the bi-level data to the COLUMN/segment lines of the LCD. The counter increments from zero to four times the number of ROW/commons before being reset to zero and the waveforms repeated.

The algorithm produces one ON/select voltage ($V_{ON}$) and one OFF/non-select voltage ($V_{OFF}$) according to the following formulas. Select and non-select voltages are in alternating current root mean square (AC RMS) units:

ON/select voltage:

$$V_{ON} = \sqrt{\frac{\text{NUMBER OF ROW/COMMON LINES} + 1}{2(\text{NUMBER OF ROW/COMMON LINES})}} * \text{PULSE AMPLITUDE VOLTAGE}$$

OFF/non-select voltage:

$$V_{OFF} = \sqrt{\frac{\text{NUMBER OF ROW/COMMON LINES} - 1)}{2(\text{NUMBER OF ROW/COMMON LINES})}} * \text{PULSE AMPLITUDE VOLTAGE}$$

where the pulse amplitude voltage is determined by the absolute value of the difference in voltage between bi-levels in the bi-level waveforms of either the ROW/commons or COLUMN/segments waveforms.

Thus, the select and non-select voltages formulas above follow from a graphical analysis of the pulses seen by a LCD segment stimulated by the PWM algorithm. The segment will be ON when it is pulsed greater than 50% of the time and the segment will be OFF when it is pulsed less than 50% of the time during a LCD refresh cycle. Because the LCD refresh cycle is four (4) times the desired MUX rate, the refresh cycle will have an even number of time slots. Also, because the second half of the refresh cycle is identical but inverted from the cycle first half, an ON segment will see pulses greater than half the time of the half cycle time and an OFF segment will see pulses less than half the time of the half cycle. This constrains the ON calculation to be the first number above 50% that can be achieved with integer multiples of the MUX rate which is the same as the number of ROW lines/common lines. Similarly, this constrains the OFF calculation to be the first number below 50% that can be achieved with integer multiples of the MUTX rate which is the same as the number of ROW lines/common lines.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A method of driving a passive multiplexed liquid crystal display (LCD) having a plurality of ROWs and COLUMNs configured in a matrix forming a plurality of LCD segments, the method comprising the step of:

supplying a first plurality of non-zero crossing bi-level voltage waveforms to the ROWs of the LCD;

supplying a second plurality of non-zero crossing bi-level voltage waveforms to the COLUMNs of the LCD; and stimulating the intersection of a ROW and COLUMN with the first plurality of non-zero crossing bi-level voltage waveforms and the second plurality of non-zero crossing bi-level voltage waveforms respectively to initiate an ON or OFF state of an LCD segment.

2. A method of driving a passive multiplexed liquid crystal display (LCD) as in claim 1, wherein the ROW voltage waveforms are substantially periodic and fixed in shape.

3. A method of driving a passive multiplexed liquid crystal display (LCD) as in claim 1, wherein the second plurality of non-zero crossing bi-level voltage waveforms for the COLUMNS are formed from the desired ON or OFF state by either copying a binary equivalent directly to a COLUMN output port of the LCD or copying and inverting the ON or OFF state to a COLUMN output port.

4. A method of producing a bi-level waveform on the ROW/common lines and the COLUMN/segment lines of a multiplexed liquid crystal display (LCD) using a predetermined algorithm for driving the output of the display with binary data from at least one display memory location, comprising the steps of:

a) initializing a counter;

b) determining a first predetermined bi-level data waveform;

c) sending the first predetermined bi-level data waveform to a ROW/common of the LCD based upon the value of the counter;

d) determining a second predetermined bi-level data waveform;

e) sending the second predetermined bi-level data waveform to a COLUMN/segment of the LCD based upon the value of the counter;

f) delaying for a subsequent LCD refresh period;

g) incrementing the counter;

h) determining if a counter value represents a number of iterations through the algorithm equal to four times the number of LCD ROW/commons in the LCD; and i) reinitializing the counter as in step a) if the counter value represents a number of iterations through the algorithm equal to four times the number of LCD ROW/COLUMNs or determining a new first predetermined bi-level data waveform as in step b) and continuing steps thereafter.

5. A method of producing a bi-level waveform as in claim 4 wherein the first predetermined bi-level data waveform is determined using a first look-up table.

6. A method of producing a bi-level waveform as in claim 5 wherein the second predetermined bi-level waveform is determined using a second look-up table.

7. A method of producing a bi-level waveform as in claim 6 wherein the LCD is temperature compensated by selectively modifying values in either the first look-up table or second look-up table.

8. A method of producing a plurality of bi-level waveforms from a microprocessor to the ROW/common lines and COLUMN/segment lines of a passive multiplexed liquid crystal display (LCD) comprising the steps of:

a) storing binary display data in a plurality of display memory locations;

b) initializing at least one counter and providing a counter value;

c) utilizing the counter value to produce bi-level display data for driving the ROW/common lines of the LCD;

d) utilizing the counter value to produce bi-level data for driving the COLUMN/segment lines of the LCD;

e) incrementing the counter;

f) determining if a counter value represents a number of iterations through the steps a) through e) equal to four times the number of LCD ROW/commons in the LCD;

g) reinitializing the counter as in step b) if the counter value represents a number of iterations through the steps a) through f) that is equal to four times the number of LCD ROW/common lines or COLUMN/segment lines; and h) determining new bi-level display data as in step c) and continuing all steps thereafter if the counter value does not represent a number of iterations through steps a) through f) that is equal to four times the number of LCD ROW/common lines or COLUMN/segment lines.

9. A method of producing a plurality of bi-level display waveforms as in claims 8, wherein the bi-level display data in step c) and step d) are either an ON/select voltage or an OFF/on-select voltage that is used for displaying information on segments of the LCD.

10. A method of producing a plurality of bi-level display waveforms as in claim 9, wherein the ON/select voltage ($V_{ON}$) is determined by:

$$V_{ON} = \sqrt{\frac{\text{NUMBER OF ROW/COMMON LINES} + 1}{2(\text{NUMBER OF ROW/COMMON LINES})}} * \text{PULSE AMPLITUDE VOLTAGE}$$

wherein the pulse amplitude voltage is determined by the absolute value of the difference in voltage between bi-levels in the bi-level waveforms of either a ROW/common line waveform or a COLUMN/segment line waveform.

11. A method of producing a plurality of bi-level display waveforms as in claim 9, wherein the OFF/non-select voltage ($V_{OFF}$) is determined by:

$$V_{OFF} = \sqrt{\frac{\text{NUMBER OF ROW/COMMON LINES} - 1)}{2(\text{NUMBER OF ROW/COMMON LINES})}} * \text{PULSE AMPLITUDE VOLTAGE}$$

wherein the pulse amplitude voltage is determined by the absolute value of the difference in voltage between bi-levels in the bi-level waveforms of either a ROW/common line waveform or COLUMN/segment line waveform.

* * * * *